US007105472B2

(12) United States Patent
Zepf

(10) Patent No.: US 7,105,472 B2
(45) Date of Patent: Sep. 12, 2006

(54) COATING SOLUTION FOR METALS AND METAL ALLOYS

(76) Inventor: Walter Zepf, Byk-Gulden-Str. 10 + 13, 78467 Konstanz/Bodensee (DE)

( * ) Notice: Subject to any disclaimer, the term of this patent is extended or adjusted under 35 U.S.C. 154(b) by 339 days.

(21) Appl. No.: 10/406,565

(22) Filed: Apr. 4, 2003

(65) Prior Publication Data

US 2003/0216265 A1 Nov. 20, 2003

Related U.S. Application Data

(60) Provisional application No. 60/369,561, filed on Apr. 4, 2002.

(51) Int. Cl.
*C10M 125/00* (2006.01)
*C23C 22/07* (2006.01)

(52) U.S. Cl. ..... 508/128; 508/168; 508/364; 508/423; 72/42; 148/253; 148/255; 106/14.12; 106/14.15; 106/14.21

(58) Field of Classification Search ..... 508/128, 508/168, 364, 423; 148/253, 255; 106/14.12, 106/14.15
See application file for complete search history.

(56) References Cited

U.S. PATENT DOCUMENTS 3,869,317 A * 3/1975 Marx ..... 148/245
4,257,902 A * 3/1981 Singer ..... 508/185
4,497,667 A * 2/1985 Vashi ..... 148/254
5,495,737 A * 3/1996 Graham ..... 72/42
5,518,639 A * 5/1996 Luk et al. ..... 508/116
5,711,996 A * 1/1998 Claffey ..... 427/388.4
6,241,830 B1 * 6/2001 Shimakura et al. ..... 148/251
6,309,477 B1 10/2001 Shimakura et al.
6,376,433 B1 * 4/2002 Connor ..... 508/163
6,805,756 B1 * 10/2004 Claffey et al. ..... 148/259

FOREIGN PATENT DOCUMENTS

EP 0 613 939 A2 9/1994
EP 0 714 975 A1 6/1996
FR 2 378 084 8/1978
JP 2001303262 A 10/2001

OTHER PUBLICATIONS

European Patent Office, European Search Report, Application No. EP 02 00 7662, 3 pages.

* cited by examiner

*Primary Examiner*—Ellen M. McAvoy
(74) *Attorney, Agent, or Firm*—Buchanan Ingersoll & Rooney PC

(57) ABSTRACT

The present invention relates to a coating solution to be applied on the surface of metals or metal alloys, a process for cold forming of metals and metal alloys using said coating solution, and a coated blank made of a metal or a metal alloy.

28 Claims, No Drawings

COATING SOLUTION FOR METALS AND METAL ALLOYS

This application claims priority under 35 U.S.C. 119 to U.S. Provisional Application No. 60/369,561 entitled COATING SOLUTION FOR METALS AND METAL ALLOYS and filed on Apr. 4, 2002, the entire content of which is hereby incorporated by reference.

FIELD OF THE INVENTION

The present invention relates to a coating solution to be applied onto the surface of metals or metal alloys, a process for cold forming of metals and metal alloys using said coating solution, and a coated blank made of a metal or a metal alloy.

BACKGROUND OF THE INVENTION

In cold forming, no heat is applied to the metallic workpiece before forming. However, its temperature can increase during the forming process, as the energy expanded in forming is almost completely converted into heat. The main advantages of cold forming are the saving of materials and working time, the use of lower strength steels, the improved quality of workpieces, lower machine costs, better size accuracy, high surface quality and an extended tool life. In order to achieve these advantages, a protective film must be formed between the tool and the work piece, which must remain intact during the working process. Such a protective film is mainly made up of molybdenum disulfide dispersions or graphite as lubricants. Hitherto, in order to obtain such a protective lubricating film in cold forming processes, lubricant carriers are applied onto the surface of the workpiece, which can absorb about five times the quantity of lubricants compared to the untreated metal surface. However, the application of such lubricant carriers onto the surface of workpieces is carried out by applying aggressive acids and metallic soaps in huge amounts, which is not desirable from an ecological standpoint.

SUMMARY OF THE INVENTION

It is an object of the present invention is to provide a new system for cold forming of metals and metal alloys, which should avoid the treatment of the working piece with aggressive acids and/or metallic soaps prior to the cold forming process, but should exhibit at least the same results compared to a cold forming process using workpieces treated with aggressive acids and/or metallic soaps.

In particular, there is provided a coating solution to be applied onto the surface of a metal or a metal alloy, comprising a polyphosphate and a dithiocarbamate.

DETAILED DESCRIPTION OF THE INVENTION

In a preferred embodiment of the present invention, the polyphosphate is selected from the group consisting of ammonium polyphosphate and alkali metal polyphosphates, such as sodium polyphosphate, or mixtures thereof. The amount of said polyphosphate is preferably in the range of from about 0.1% (w/v) to about 80% (w/v).

The dithiocarbamate is preferably a dialkyl dithiocarbamate, wherein the alkyl groups are the same or different and can have 1 to 12 carbon atoms. In a preferred embodiment of the present invention the dithiocarbamate is a heavy metal dithiocarbamate, wherein the heavy metal is for example molybdenum. In a more preferred embodiment of the present invention the dithiocarbamate is a molybdenum dibutyldithiocarbamate. The amount of said dithiocarbamate is preferably in the range of from about 0.1% (w/v) to about 80% (w/v).

The coating solution of the present invention can further include graphite and/or molybdenum disulfide, each of which can be present preferably in an amount of from about 0.1% (w/v) to about 80% (w/v).

In a preferred embodiment of the present invention the coating solution may further contain at least one component selected from the group consisting of alcohols in an amount of from 0% to about 100% (v/v); waxes such as polyalkylene waxes, e.g. polyethylene waxes, microcrystalline waxes, and Montan ester waxes, in an amount of from 0% to about 80 (v/v); emulsifying agents such as alkyloxyethylates and alkylaryloxyethylates, in an amount of from 0% to about 50% (v/v); pH-modulating agents such as buffers, e.g. phosphorous acid and esters thereof, in an amount of from 0% to about 50% (v/v), polymeric compounds such as polyethylene glycols, preferably having a weight average molecular weight of from 500 to 1,000,000, polysaccharides and methylcellulose, in an amount of from 0% to about 50% (v/v); oxides such as silicon dioxide, in an amount of from 0% to about 50% (v/v); friction-reducing agents such as sodium stearate, in an amount of from 0% to about 80% (v/v); defoaming agents such as fatty alcohol polyglycol ethers, in an amount of from 0% to about 50% (v/v); carboxylic acids and derivatives thereof such as 2-phosphonobutanetricarboxylic acid, in an amount of from 0% to about 50% (v/v); organophosphorous compounds such as alkylphosphates, in an amount of from 0% to about 5% (v/v); and phosphates such as boron phosphate, sodium phosphate, $P_2O_5$ etc., in an amount of from 0% to about 80% (v/v); and mixtures thereof containing two or more of said components.

In a preferred embodiment of the present invention, the coating solution has a pH-value ranging from about 3 to about 4, adjusted by the above-defined pH-modulating agent.

The solvent used for the coating solution of the present invention is $H_2O$ in an amount of from 0% to 100% (v/v), alcohols, preferably alcohols having up to 10 carbon atoms such as methanol, ethanol, etc., or a mixture of different alcohols, in an amount of from 0% to 100% (v/v), or a $H_2O$/alcohol-mixture in an amount of from 0% to 100% (v/v).

Further, the present invention relates to a process for cold forming of metals or metal alloys, comprising the steps of:

(a) immersing a blank of a metal or a metal alloy in a bath containing the above-defined coating solution for a time period of from about 30 seconds to about 10 minutes;

(b) drying said blank having the coating solution on its surface at a temperature ranging from about room temperature to about 80° C., preferably from about 50° C. to about 60° C., wherein the drying is carried cut preferably in hot air or in a drying stove; and (c) subjecting the thus-coated blank to cold forming.

In the preferred embodiment, the blank can be sandblasted prior to the above process step (a).

Further, there is provided a blank made of a metal or a metal alloy such as steel, having a coating obtainable by the above-defined process steps (a) and (b).

When using the above-defined coating solution for the treatment of blanks ("workpieces") to be processed in cold forming, there can be observed that on the one hand the coating solution of the present invention does not exhibit the severe drawbacks with respect to environmental pollution, and on the other hand the blanks having a coating based on the coating solution of the present invention show at least the same results for the processed workpiece and the tool when compared with blanks having a coating known in the prior art. Moreover, the cold forming process using blanks treated with the coating solution of the present invention is superior from an economical standpoint, i.e. the weight of the coating on the blank is much less as compared to the weight of a coating known in the art. Additionally, in comparison with a coating procedure known in the art, wherein about eleven steps for applying the coating on the blank are necessary, only two steps—(i) immersing the blank in the coating soluting according to the pursuant invention and then (ii) drying the blank—are necessary resulting in a drastically saving of time.

The present invention will now be further illustrated in the following examples, without being limited thereto.

EXAMPLES 25 cylindrically shaped steel blanks (examples 1 to 25) having a length of 500 mm are immersed in a coating solution containing 2–8% (w/v) polyphosphate, 2–5% (w/v) dithiocarbamate, 5–12% (w/v) graphite and 5–12% (w/v) molybdenum disulfid for a time period of about 1 min. Then, the blanks having the coating solution on their surfaces are transferred to a drying stove wherein they are dried at a temperature of about 60° C. for about 30 min. For comparison, 5 cylindrically shaped steel blanks (Comp. Examples 1 to 5) having a length of 500 mm are coated using the agents and procedure known in the art. The results are summarised in Table 1.

TABLE 1

| Examples | blank weight before coating [g] | blank weight after coating [g] | weight of coating [g] | cold forming of coated blanks |
|---|---|---|---|---|
| 1 | 5583.2 | 5584.3 | 1.1 | + |
| 2 | 5558.1 | 5559.6 | 1.5 | + |
| 3 | 5560.3 | 5561.2 | 0.9 | + |
| 4 | 5562.1 | 5563.0 | 0.9 | + |
| 5 | 5552.7 | 5553.9 | 1.2 | + |
| 6 | 5532.6 | 5533.6 | 1.0 | + |
| 7 | 5538.4 | 5539.3 | 0.9 | + |
| 8 | 5552.9 | 5554.8 | 1.9 | + |
| 9 | 5564.1 | 5565.1 | 1.0 | + |
| 10 | 5554.2 | 5555.9 | 1.7 | + |
| 11 | 5553.9 | 5558.7 | 2.8 | + |
| 12 | 5547.6 | 5556.6 | 1.0 | + |
| 13 | 5560.0 | 5561.1 | 1.1 | + |
| 14 | 5568.7 | 5569.6 | 0.9 | + |
| 15 | 5573.0 | 5571.2 | 0.9 | + |
| 16 | 5563.0 | 5563.8 | 0.8 | + |
| 17 | 5572.0 | 5573.0 | 1.0 | + |
| 18 | 5570.6 | 5571.5 | 0.9 | + |
| 19 | 5562.1 | 5563.0 | 0.9 | + |
| 20 | 5559.1 | 5559.9 | 0.8 | + |
| 21 | 5570.7 | 5571.8 | 1.1 | + |
| 22 | 5572.8 | 5573.4 | 0.6 | + |
| 23 | 5561.1 | 5562.7 | 1.6 | + |
| 24 | 5563.2 | 5564.0 | 0.8 | + |
| 25 | 5563.7 | 5564.8 | 1.1 | + |
| | | Comp. Example | | |
| 1 | 5531.0 | 5560.1 | 29.1 | + |
| 2 | 5526.8 | 5557.0 | 30.2 | + |
| 3 | 5535.4 | 5562.3 | 26.9 | + |
| 4 | 5533.4 | 5563.1 | 29.7 | + |
| 5 | 5532.6 | 5551.5 | 18.9 | + |

As can be taken from Table 1, the coated blanks according to the present invention exhibit a drastically reduced coating weight, but the coating reveals at least the same properties for the blank to be cold formed as the coating of blanks obtained according to the prior art, upon evalution of the processed coated blanks during and after their cold forming (+=good results of the formed blanks after 3 operations in a cold forming process).

I claim:

1. A coating solution to be applied on a surface of metals or metal alloys, comprising a polyphosphate, a dithiocarbamate, graphite and molybdenum disulfide.

2. The coating solution according to claim 1, wherein said polyphosphate is selected from the group consisting of ammonium polyphosphate, alkali metal polyphosphates, and a mixture thereof.

3. The coating solution according to claim 1, wherein the amount of said polyphosphate is in the range of from about 0.1% (w/v) to about 80% (w/v).

4. The coating solution according to claim 1, wherein said dithiocarbamate is a dialkyl dithiocarbamate.

5. The coating solution according to claim 4, wherein said dithiocarbamate is a heavy metal dithiocarbamate.

6. The coating solution according to claim 1, wherein the amount of said dithiocarbamate is in the range of from about 0.1% (w/v) to about 80% (w/v).

7. The coating solution according to claim 1, further comprising at least one component selected from the group consisting of alcohols, waxes, emulsifying agents, pH-modulating agents, polymeric compounds, oxides, friction-reducing agents, defoaming agents, carboxylic acids and derivatives thereof, organophosphorous compounds, phosphates, and mixtures thereof containing two or more of said components.

8. The coating solution according to claim 1, having a pH-value ranging from about 3 to about 4.

9. A process for cold forming of metals or metal alloys, comprising the steps of:

(a) immersing a blank of a metal or a metal alloy in a bath comprising a coating solution comprising a polyphosphate, a dithiocarbamate, graphite and molybdenum disulfide, for a time period of from about 30 seconds to about 10 minutes;

(b) drying said blank having the coating solution on its surface at a temperature ranging from about room temperature to about 80° C.; and (c) subjecting the thus-coated blank to cold forming.

10. The process according to claim 9, wherein prior to step (a) the blank is sandblasted.

11. The process according to claim 9, wherein said polyphosphate is selected from the group consisting of ammonium polyphosphate, alkali metal polyphosphates, and a mixture thereof.

12. The process according to claim 9, wherein the amount of said polyphosphate is in the range of from about 0.1% (w/v) to about 80% (w/v).

13. The process according to claim 9, wherein said dithiocarbamate is a dialkyl dithiocarbamate.

14. The process according to claim 9, wherein said dithiocarbamate is a heavy metal dithiocarbamate.

15. The process according to claim 9, wherein the amount of said dithiocarbamate is in the range of from about 0.1% (w/v) to about 80% (w/v).

16. The process according to claim 9, wherein said coating solution further comprises at least one component selected from the group consisting of alcohols, waxes, emulsifying agents, pH-modulating agents, polymeric compounds, oxides, friction-reducing agents, defoaming agents, carboxylic acids and derivatives thereof, organophosphorous compounds, phosphates, and mixtures thereof containing two or more of said components.

17. The process according to claim 9, wherein said coating solution has a pH-value ranging from about 3 to about 4.

18. A blank comprising a coating obtainable by (a) immersing a blank of a metal or a metal alloy in a bath comprising a coating solution comprising a polyphosphate, a dithiocarbamate, graphite and molybdenum disulfide, for a time period of from about 30 seconds to about 10 minutes; and (b) drying said blank having the coating solution on its surface at a temperature ranging from about room temperature to about 80° C., resulting in a coated blank.

19. The blank according to claim 18, wherein said polyphosphate is selected from the group consisting of ammonium polyphosphate, alkali metal polyphosphates, and a mixture thereof.

20. The blank according to claim 18, wherein the amount of said polyphosphate is in the range of from about 0.1% (w/v) to about 80% (w/v).

21. The blank according to claim 18, wherein said dithiocarbamate is a dialkyl dithiocarbamate.

22. The blank according to claim 18, wherein said dithiocarbamate is a heavy metal dithiocarbamate.

23. The blank according to claim 18, wherein the amount of said dithiocarbamate is in the range of from about 0.1% (w/v) to about 80% (w/v).

24. The blank according to claim 18, wherein said coating solution further comprises at least one component selected from the group consisting of alcohols, waxes, emulsifying agents, pH-modulating agents, polymeric compounds, oxides, friction-reducing agents, defoaming agents, carboxylic acids and derivatives thereof, organophosphorous compounds, phosphates, and mixtures thereof containing two or more of said components.

25. The blank according to claim 18, wherein said coating solution has a pH-value ranging from about 3 to about 4.

26. The coating solution according to claim 1, wherein the polyphosphate is present in an amount of 2 to 8% (w/v), the dithiocarbamate is present in an amount of 2 to 5% (w/v), the graphite is present in an amount of 5 to 12% (w/v), and the molybdenum disulfide is present in an amount of 5 to 12% (w/v).

27. The process according to claim 9, wherein the polyphosphate is present in an amount of 2 to 8% (w/v), the dithiocarbamate is present in an amount of 2 to 5% (w/v), the graphite is present in an amount of 5 to 12% (w/v), and the molybdenum disulfide is present in an amount of 5 to 12% (w/v).

28. The blank according to claim 18, wherein the polyphosphate is present in an amount of 2 to 8% (w/v), the dithiocarbamate is present in an amount of 2 to 5% (w/v), the graphite is present in an amount of 5 to 12% (w/v), and the molybdenum disulfide is present in an amount of 5 to 12% (w/v).

* * * * *